United States Patent [19]

Hara et al.

[11] Patent Number: 4,704,975

[45] Date of Patent: Nov. 10, 1987

[54] UPPER AND LOWER THREAD TENSION DEVICES FOR SEWING MACHINE

[75] Inventors: Kazumasa Hara; Akiyoshi Sasano, both of Tokyo; Mikio Koike, Oume, all of Japan

[73] Assignee: Janome Sewing Machine Co. Ltd., Tokyo, Japan

[21] Appl. No.: 865,550

[22] Filed: May 20, 1986

[30] Foreign Application Priority Data

May 23, 1985 [JP] Japan ..... 109379

[51] Int. Cl.[4] ..... D05B 63/00; D05B 47/02

[52] U.S. Cl. ..... 112/238; 112/229; 112/254

[58] Field of Search ..... 112/238, 254, 229, 255

[56] References Cited

U.S. PATENT DOCUMENTS 3,996,866 12/1976 Bianchi ..... 112/254

4,289,087 9/1981 Takenoya et al. ..... 112/254

4,429,649 2/1984 Eguchi et al. ..... 112/254

4,458,613 7/1984 Eguchi et al. ..... 112/229 X 4,638,751 1/1987 Hanyee et al. ..... 112/229 X

*Primary Examiner*—Werner H. Schroeder

*Assistant Examiner*—Andrew M. Falik

*Attorney, Agent, or Firm*—Michael J. Striker

[57] ABSTRACT

A lower thread tension device is provided in association with adjustment of an upper thread tension device in such a manner that when the tension of the upper thread tension device is strong within an adjusting range, the lower thread tension is adjusted strongly, and when the tension of the upper thread tension device is weak within the adjusting range, the lower thread tension is adjusted weakly. The upper and lower thread tension device includes a dial for adjusting an upper thread tension, a potentiometer connected to the dial, and an electromagnet with an actuator acting on the lower thread to adjust its tension in response to a signal received from the potentiometer due to rotation of the dial.

5 Claims, 16 Drawing Figures

FIG_5
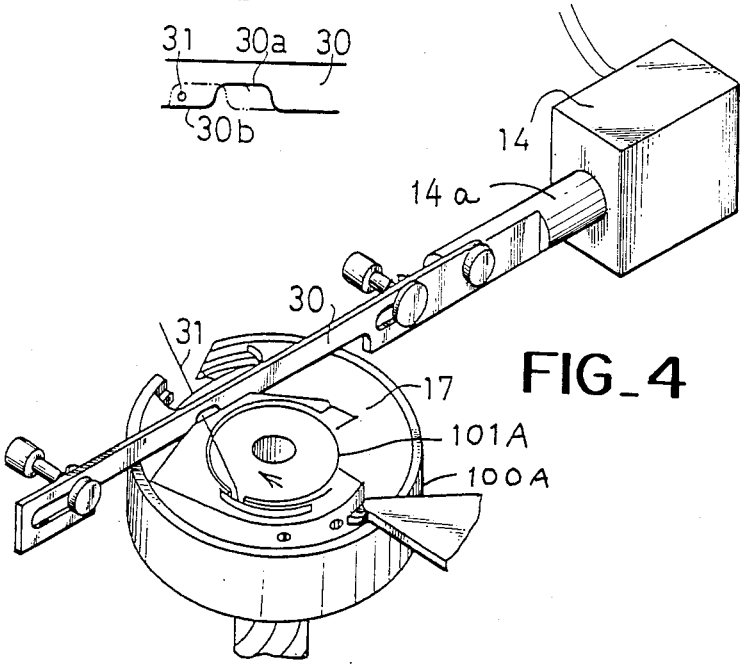
FIG_4
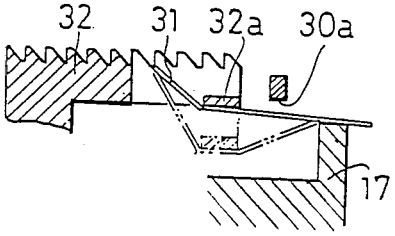
FIG_6
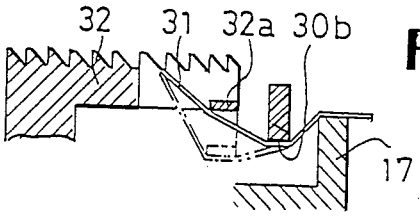
FIG_7

FIG_8
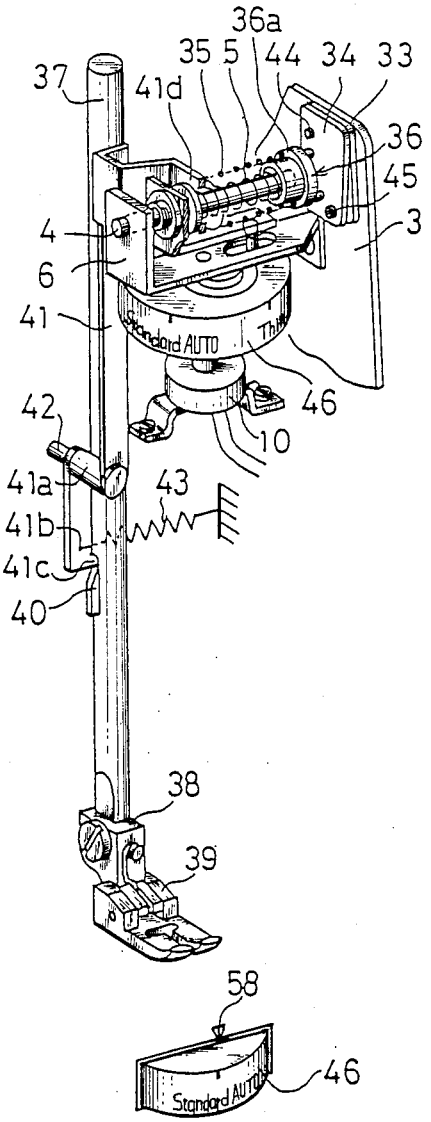
FIG_16
FIG_12
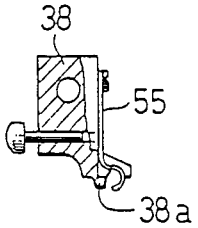
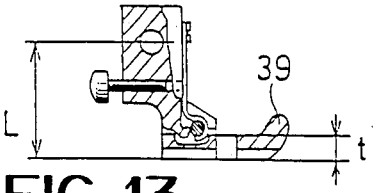
FIG_13
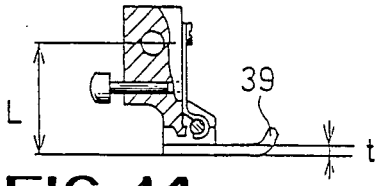
FIG_14
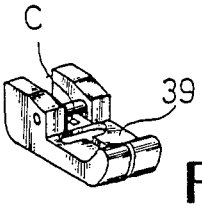
FIG_15

UPPER AND LOWER THREAD TENSION DEVICES FOR SEWING MACHINE

BACKGROUND OF THE INVENTION

The present invention relates to a device for adjusting thread tension and a thread drawing amount in a sewing machine.

An operator of the sewing machine normally adjusts an upper thread tension device with reference to the data of sewing conditions such as fabric sorts, thread sorts, stitching patterns, needle amplitude amount, fabric feed amount, etc., in order to position crossing points of an upper thread and a lower thread in a center of a fabric being stitched.

However, when the upper thread tension device is adjusted in response to the stitching conditions, for example, when the thread is tightened for a thick fabric or when a measure is prepared for shrinkages of the fabric in the thin fabrics or a pattern stitching with a large width such as zigzag stitching, the lower thread should be adjusted in addition to and in compliance with the adjustment of the upper thread. But satisfied stitches could not be produced with the adjustment of the upper thread only.

SUMMARY OF THE INVENTION

It is an object of this invention to provide a lower thread tension device in association with the adjustment of an upper thread tension device in such a manner that when thread tension of the upper thread tension device is strong within an adjusting range, the lower thread tension is adjusted strongly, and when the thread tension of the upper thread tension device is weak within the adjusting range, the lower thread tension is adjusted weakly.

BRIEF DESCRIPTION OF THE DRAWINGS

FIG. 4 is a perspective view of the device which adjusts a lower thread by changing an amount of the lower thread drawn from the bobbin;

FIG. 5 is a schematic view showing the actuation of the device of FIG. 4;

FIGS. 6 and 7 are sectional views of the feed dog and the bobbin carrier for different conditions of the thread pulled from the bobbin;

FIG. 8 is a perspective view of the device for adjusting the upper thread tension of another embodiment;

FIG. 12 is a partial cross sectional view of a presser holder;

FIG. 13 is a partial cross-sectional view of the presser holder and the presser foot attached thereto;

FIG. 14 is a partial cross-sectional view of the presser holder and the presser foot for a fabric having a specific thickness;

FIG. 15 is a perspective view of a presser foot; and

FIG. 16 is a perspective view of an operating part of the thread tension device.

DETAILED DESCRIPTION OF THE PREFERRED EMBODIMENTS

Figure 1:
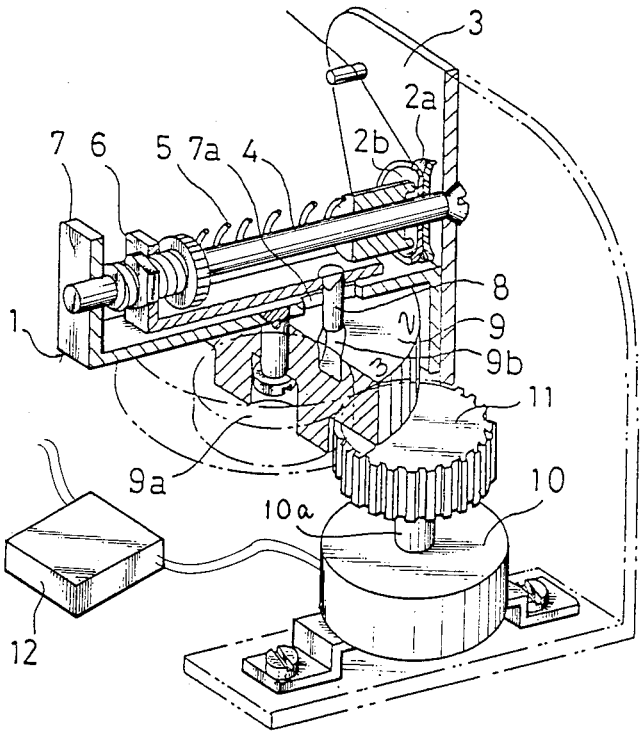
FIG. 1 is a perspective view, partially in section, of an upper thread tension device of a first embodiment of the invention.

As shown in FIG. 1, an upper thread tension device 1 has a pair of thread tension discs 2*a*, 2*b* which are mounted on a thread tension shaft 4 secured to a thread tension bed 3 at its one end and in a support 7 at the other end. Discs 2*a*, 2*b* are biased by a slider 6 pressing a spring 5.

The thread tension shaft support 7 is fixed to the thread tension bed 3. The slider 6 has a pin which fits in an oblong groove 7*a* formed in the thread tension shaft support 7 and in a guide groove 9*b* of a dial 9 which is, at its lower part, rigidly fixed with a gear 9*a* which is in mesh with a gear 11 mounted on a shaft 10*a* of a potentiometer 10 supported on the thread tension bed 3. An output signal of the potentiometer 10 is transmitted to a differential amplifier circuit 12, and an output signal of the latter is transmitted to a solenoid 13 shown in FIG. 2.

Figure 2:
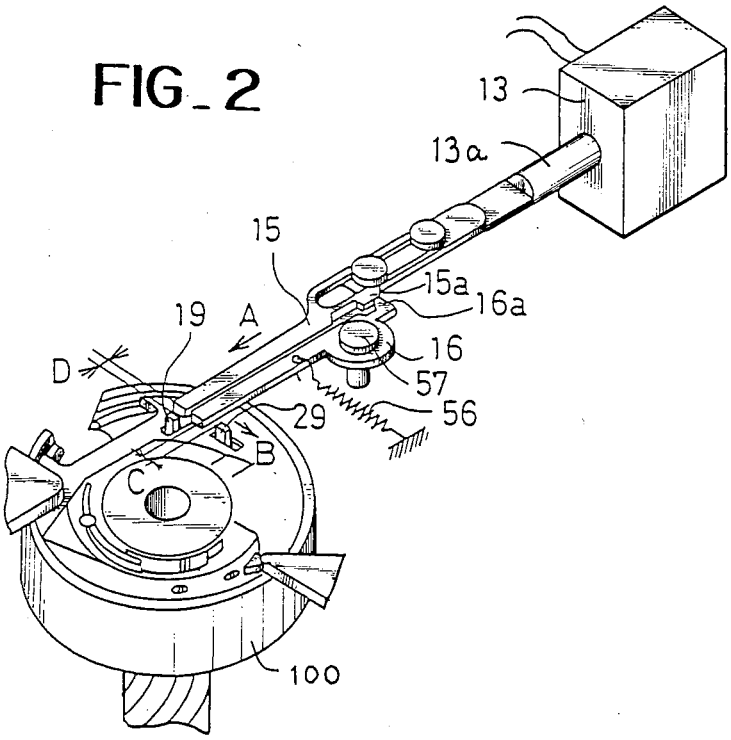
FIG. 2 is a perspective view of a lower thread tension device.
Figure 3:
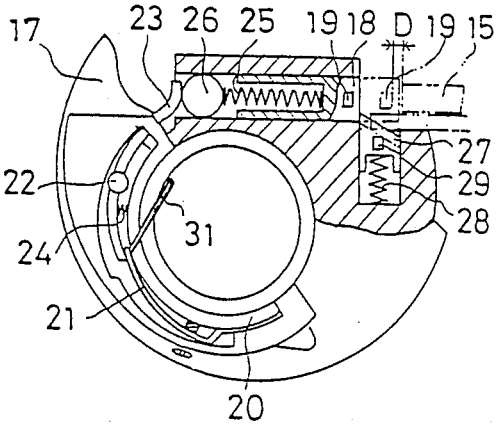
FIG. 3 is a partial cross-sectional view of FIG. 2.

The lower thread tension device is shown in FIGS. 2 and 3. The lower thread tension device includes an actuating lever 15 connected to a plunger 13*a* of the solenoid 13. A rotation lever 16 which is a second actuating lever is pivoted to a machine frame via a pin 57, and an end point 16*a* of the rotation lever 16 contacts a cam face 15*a* of the actuating lever 15 due to a biasing force of a reset spring 56.

A loop taker 100 is rotated in a conventional manner to catch an upper thread loop.

The actuating lever 15 which faces a pin 19 of a cylinder 18 of a bobbin carrier 17 is moved to a position shown with a two-dotted line in FIG. 3, with a space D for passing an upper thread loop from said thread tension device 1, when the tension of the upper thread is weak within an adjusting range.

The bobbin carrier 17 is provided with a lower thread tension bed 20 and with a lower thread tension spring 21 which presses a lower thread 31 guided towards the lower thread tension bed 20 and which is contacted at its end by a lever 23 rotating around a fulcrum of a lever pin 22. A spring 24 is disposed between a contacting point of the lever 23 and the lever 22 so as to release the contact therebetween.

The lever 23 contacts with its other end a ball 26 biased in one direction by a spring 25 mounted within the cylinder 18 of the bobbin carrier 17. A stopper 27 is provided in the bobbin carrier 17 and slides therewithin and has a spring 28 which contacts the cylinder 18 at its end at the position shown with double-dotted line. The rotation lever 16 is held with a space C in relation with a stopper pin 29 for passing an upper thread loop.

The actuation of the device according to the invention will be now explained below. When the dial 9 of the upper thread tension device 1 is rotated with a part of the adjusting range the pin 8 is guided in the eccentric groove 9*b* of the dial 9 and the oblong groove 7*a* of the shaft support 7, and the slider 6 integral with the pin 8 slides axially of the thread tension shaft 4 so as to change a pressing force of the spring 5 and adjust the upper thread tension.

When the thread tension of the upper thread tension device is made strong within the adjusting range by rotation of the dial 9 a signal from the differential amplifier circuit 12 which is output of the signal from the potentiometer 10 is transmitted to the solenoid 13, and the actuating lever 15 is pushed by plunger 13*a* in a direction A (FIG. 2). Then, the pressure of the spring 25 is made greater than that of the minor spring 24 by rotating the lever 23 around the fulcrum of the lever pin 22 so that the lower thread tension spring 21 is pressed down and gives tension to the lower thread 31.

When the tension of the upper thread tension device 1 is made weak within the adjusting range by rotation of the dial 9, the solenoid 13 is actuated by the signal from the differential amplifier circuit 12 which receives a respective signal of the potentiometer 10 connected to the dial 9 so that plunger 13*a* of solenoid 13 moves the actuating lever 15 in a direction opposite to that of arrow A.

The end part of the rotating lever 16 is rotated in the direction B of FIG. 2 by a cam face 15*a* of the actuating lever 15 and the resetting spring 56 and engages pin 29 of the stopper 27 against the action of spring 28 and thus presses the stopper 27 via the pin 29, so that the cylinder 18 of the bobbin carrier 17 is released as shown with dotted line in FIG. 3. When the lever 23 is turned in the clockwise direction by spring 24 one end of lever 23 is moved away from spring 21 whereas its other end acts on ball 26 and urges cylinder 18 to the position shown by solid line in FIG. 3. If the pressure of the spring 25 is made smaller than that of the minor spring 24 the lever 23 is rotated around the fulcrum of the lever pin 22 so that the lower thread tension spring 21 is released from pressure.

FIGS. 4 to 7 illustrate another embodiment of this invention. This embodiment adjusts the lower thread by adjusting the amount of the lower thread drawn from the bobbin 101A. In FIG. 4, an output signal of the differential amplifier circuit 12 shown in FIG. 1 is transmitted to a solenoid 14 which has a plunger 14*a* connected to a lever 30 for limiting the amount of the lower thread drawn from the bobbin 101A. The limiting lever 30 is formed with a recess 30*a* at a lower edge 30*b* (FIG. 5) for adjusting the lower thread 31.

A loop taker 100A with the bobbin carrier 17 is of the same structure as the loop taker 100 mentioned hereinabove.

The mode of operation of the embodiment of FIGS. 4–7 is as follows:

The upper thread tension is adjusted by rotation of the dial 9 as in the first embodiment, and a signal from the potentiometer 10 is fed to the differential amplifier circuit 12, and the solenoid 14 is driven by the output signal from the differential amplifier circuit 12.

When the upper thread tension of the device 1 is strong within the adjusting range thereof, the limit lever 30 connected to the plunger 14*a* of the solenoid 14 is positioned as shown with the solid line in FIG. 5, and edge 30*b* of the limit lever 30 is positioned so as to interfere with the lower thread 31 as seen in FIG. 7.

Under this condition, the amount of the lower thread drawn from the bobbin carrier 17 by vertical movement of a lower thread drawing part 32*a* of a feed dog 32, is made smaller than the amount of the lower thread drawn when the edge 30*b* of lever 30 does not interfere with the lower thread. The lower thread tension is set more or less strong by making the amount of the lower thread drawn from the bobbin 101A.

When the upper thread tension is adjusted to be weak within the adjusting range by rotation of the dial 9 of the upper thread tension device 1, the solenoid 14 is again driven by the differential amplifier circuit 12 which receives the signal from the potentiometer 10, the limiting lever 30 is set at a position so as not to limit the amount of the lower thread drawn from the bobbin, i.e., the position where recess 30*a* of the limiting lever 30 is above the lower thread 31 (FIG. 5).

The limiting lever 30 is positioned so as to not act on the lower thread 31 by the vertical movement of the feed dog 32, and the amount of the lower thread drawn from the bobbin is greater than that of the aforementioned situations. If the amount of the lower threads drawn from the bobbin 101A is made greater, the lower thread tension is set to be weak.

FIGS. 8 to 16 illustrate yet another embodiment of the upper thread tension device. In FIG. 8, numerals 33, 34 designate two thread tension discs. A structure for giving the thread tension to the discs 33, 34 is, in addition to the thread tension device 1 of the first embodiment, provided with a further tension spring 35 encircling the spring 5. A presser body 36 is mounted on the thread tension shaft 4 and receives the pressure of the spring 5 at its end and also receives the pressure of further tension spring 35 at its flange 36*a*.

The reference numeral 37 indicates a presser bar which is vertically movable in the machine frame, and is detachably-attached with a presser foot 39 by a presser holder 38, and provided with a cam piece 40 secured in a hole formed therein.

A lever 41 is inserted in a hole formed in a shaft 41*a*, which with a pin 42 is secured to the machine frame so that the end part 41*d* of the lever 41 is pivotally supported on pin 42. An end 41*c* of the lever 41 is in contact with a cam piece 40 due to action of a spring 43 attached to the end 41*b*. The end part 41*d* of the lever 41 is fork-shaped and is connected to the spring 5 and also contacts the tension spring 35.

Figure 10:
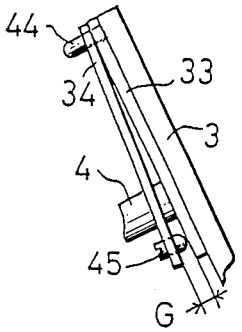
FIG. 10 is a view seen from arrow E of FIG. 9.
Figure 9:
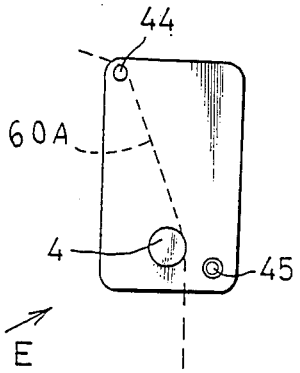
FIG. 9 is a front view of the thread tension disc.

The thread tension discs 33, 34 have the same structure as those in FIGS. 9 and 10. A positioning pin 44 and the thread tension shaft 4 pass through the thread tension disc 3 and the thread tension discs 33, 34.

The thread tension disc 34 is provided with an adjusting screw 45 for defining an oblique space between the discs 33 and 34, which will be adjusted by the amount of screwing of screw 45.

A dial 46 is labelled with "Standard AUTO" showing an adjusting position of the thread tension device in response to a standard stitching condition and "Thin AUTO" showing an adjusting position of the thread tension device in response to thin fabrics to be used and wide zigzag stitching. The machine frame has an indication mark 58 corresponding to said labellings as shown in FIG. 16.

The dial 46 is actuated in response to the stitching conditions. When the dial is rotated to meet an indication of "Standard AUTO" to said indication mark 58, the slider 6 connected to the dial 46 is moved to press the spring 5 and thus the disc 34 via the presser body 36 so as to set a thread tension.

The differential amplifier circuit 12 receives a signal from the potentiometer 10 connected to dial 46, and adjusts the lower thread tension device as described for the first and second embodiments and makes strong the lower thread, tension or makes amount of the lower thread drawn from the bobbin smaller. Subsequently the fabric to be sewn is set under the presser foot 39.

In accordance with the fabric thickness, the presser bar 37 is moved up, and the lever 41 which is in contact with the cam piece 40 is rotated and presses the thread tension spring 35 at the fork part 41*d* so as to add further spring pressure, in response to the fabric thickness, to the pressure by the spring 5. For the thin fabrics or wide zigzag stitching, the dial 46 is rotated so as to meet "Thin AUTO" to the indication,mark 58.

Figure 11:
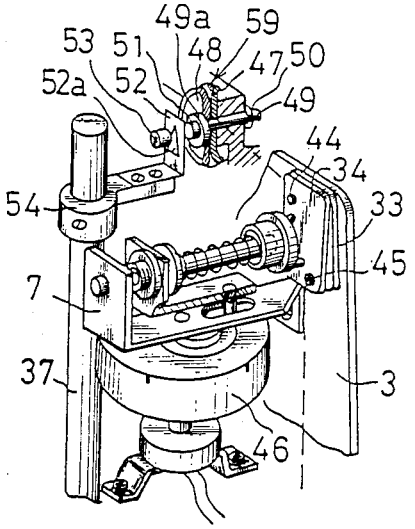
FIG. 11 is a perspective view of an auxiliary upper thread tension device for adjusting the upper thread tension according to yet another embodiment of the invention.

The slider 6 is retreated by the operation of the dial 46 to reduce the pressure of spring 5, and the differential amplifier circuit 12 receives the respective signal from the potentiometer 10 connected to the dial 46 and thus adjusts the lower thread tension device so as to make strong the lower thread tension or to make the amount of the lower thread drawn from the bobbin greater. For the thread tension adjustment in response to the fabric thickness, a subthread tension device 59 may be independently provided, as shown in FIG. 11 in cooperation with the presser bar 37.

A couple of thread tension discs 47, 48 are provided for holding a thread in a space defined therebetween. A shaft or pin 49 passes through the discs 47, 48 and a part of the machine frame and has a snap ring 50 provided at one end and, a head 49*a* provided at the opposite end thereof.

Shaft 49 also has a magnet 51 at the head 49*a*, while a magnet 53 is secured to the machine frame in opposition to magnet 51 with an interrupting plate 52 inserted between the magnets. Since the both magnets face with the same polarities, they repel each other. The shaft 49 presses the thread tension disc 48 to the thread tension disc 47.

The interrupting plate 52 is secured to an actuating body or arm 54 mounted on the presser bar 37 and is provided with a triangular hole 52*a*. Therefore, when the presser bar 37 is moved upwardly in response to the thickness of the fabric set on the feed dog, the interrupting plate 52 moves upwards accordingly, so that the distance defined by the shape of hole 52*a* of the interrupting part 52 between the magnets 51, 53 is increased and the repelling force between said magnets is increased so as to increase the holding force between the thread tension discs 47, 48.

With respect to the upward amount of the presser bar 37, the presser foot 39 can be interchanged in accordance with stitches to be formed, and therefore a number of presser feet are provided. As shown in FIGS. 13 and 14, thickness t of a fabric receiving part is varied since the height of the presser bar 37 is varied by exchanging of the presser feet.

It is assumed that the size t of the fabric receiving part is conformed to the thickness of the fabric but such conformation is not preferable because the thick parts are limited due to the maximum upward amount of the presser foot 39. FIG. 12 shows a structure where the presser holder 38 has a bottom part 38*a* for attaching thereto of the presser foot 39 by a spring 55. L-is the height of holder 38 and C is a cutout in the presser foot 39 as shown in FIGS. 13–15.

With reference to FIGS. 9 and 10, it is seen that thread 60 is guided by the positioning pin 44 and the thread tension shaft 4. Between the thread tension discs 33, 34, a space G is defined by the adjusting screw 45 rotated around the fulcrum of the positioning pin 44, and the thread 60A runs as shown with a dotted line in FIG. 9.

The thread tension is varied in response to a thickness of a thread to be used, by an appropriate oblique space between the thread tension discs 33, 34. When a thin thread is used, it contacts the thread tension discs 33, 34 at a narrow part thereof, and when a thick thread is used, it contacts all over the discs. The tensions given to the threads are different respectively, and in the general stitchings the thick thread requires stronger tension than the thin thread. If the amount of contact is adjusted by the screw 45, the tension may correspond to the thickness of the used thread, and the adjustment by the dial 46 is not required.

In accordance with the above described structure, the upper thread tension may be adjusted by operation of the upper thread tension device, and, at the same time, the lower thread tension is adjusted, so that a preferable sewing condition may be achieved.

It will be understood that each of the elements described above, or two or more together, may also find a useful application in other types of upper and lower thread tension adjusting devices for sewing machine differing from the types described above.

While the invention has been illustrated and described as embodied in an upper and lower thread tension adjusting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for adjusting upper and lower thread tension is sewing machines having an upper thread tension device with at least two disks receiving an upper thread therebetween, a spring for pressing the disks one against the other, and manually operated means including a dial operated in one direction in a maximum tension adjusting range to actuate the spring to progresively increase pressure to said disks until a maximum tension is applied to the upper thread and in another direction opposite to said one direction in the maximum tension adjusting range to actuate the spring to progressively decrease the pressure to the disks until a minimum tension is applied to the upper thread; a loop taker carrying a bobbin for a lower thread and rotated to catch a loop of the upper thread to connect the loop with the lower thread, and a feed dog having an engaging element engaging the lower thread extended between the bobbin and a fabric being sewn, the engaging element biasing the lower thread in one direction each time the feed dog is operated, to thereby draw out a predetermined amount of the lower thread from the bobbin, the upper and lower thread tension regulating device comprising electric means (10, 12) operatively connected to said dial and being set to be selectively responsive to the operation of said dial so as to produce a switching signal in response to said one direction and another direction, respectively; electromagnet means (14) having an actuator and being responsive to said switching signal to move said actuator in one direction in response to rotating said dial in said one direction, or to move said actuator in an opposite directin when said dial is rotated in said another direction; and actuating means including a lever having one end operatively connected to said actuator of said electromagnet means, said lever being so formed as to normally bias the lower thread toward a predetermined position spaced from said engaging element of said feed dog when said actuator of said electromagnet means is moved in said one direction, and to release the lower thread from said predetermined position spaced from said engaging element of said feed dog when said actuator of said electromagnet means is moved in said opposite direction.

2. The device as defined in claim 1, wherein said electric means comprises a potentiometer connected to said dial to produce electric signal, and a differential amplifier circuit which is set to be selectively responsive to one of the electric signals produced by said potentiometer, to thereby produce said switching signal.

3. The device as defined in claim 1, wherein said electromagnet means is a solenoid.

4. The device as defined in claim 1, wherein said lever has an edge for biasing the lower thread toward said predetermined position when said actuator is moved in said one direction, and a cam formed on said edge for releasing the lower thread when said actuator is moved in said opposite direction.

5. The device as defined in claim 1, wherein the sewing machine further includings a fabric presser bar having a presser foot attached to a lower end thereof, the device further comprising means operated in association with said fabric presser bar to additionally adjust the tension of the upper thread, said means including a cam provided on said fabric presser bar, a lever turnably mounted on said fabric presser bar and having an upper actuating end and a lower follower end which is in engagement with said cam, and a second spring provided between said upper actuating end of said lever and said disks.

* * * * *